US005967397A

United States Patent [19]

Fealey

[11] Patent Number: 5,967,397

[45] Date of Patent: Oct. 19, 1999

[54] STAPLE AND BRAD DRIVING TOOL

[75] Inventor: William S. Fealey, Jamestown, R.I.

[73] Assignee: The Stanley Works, New Britain, Conn.

[21] Appl. No.: 09/145,495

[22] Filed: Sep. 2, 1998

Related U.S. Application Data

[60] Provisional application No. 60/056,066, Sep. 2, 1997.

[51] Int. Cl.[6] ..... B25C 5/11

[52] U.S. Cl. ..... 227/132; 227/120; 227/109

[58] Field of Search ..... 227/109, 119, 227/132, 120

[56] References Cited

U.S. PATENT DOCUMENTS

| | | | |
|---|---|---|---|
| 3,739,973 | 6/1973 | Abrams | 227/120 |
| 3,913,817 | 10/1975 | Barrett et al. | 227/132 |
| 4,763,824 | 8/1988 | Ebihara | 227/109 |
| 5,335,839 | 8/1994 | Fealey | 227/132 |
| 5,497,932 | 3/1996 | Brewer et al. | 227/132 |
| 5,664,722 | 9/1997 | Marks | 227/132 |

*Primary Examiner*—Scott A. Smith
*Attorney, Agent, or Firm*—Pillsbury & Madison & Sutro, LLP

[57] ABSTRACT

The present invention is a fastener driving device for driving brads or staples into a workpiece. The device comprises a main body structure and magazine assembly for receiving a fastener package containing a plurality of fasteners connected together. The fasteners are staples or brads. The main body structure includes a drive track for receiving a lead fastener. A reciprocating driving structure moves through a fastener driving cycle including (1) a drive stroke and (2) a return stroke. The magazine assembly is constructed and arranged such that the lead fastener remains connected to the package until the driving structure engages the lead fastener and separates it during the drive stroke. The magazine assembly includes a movable interior fastener supporting structure and an exterior fastener guiding surface constructed and arranged to support a brad package. The interior fastener supporting structure is constructed and arranged to support a staple package when the device is being used to drive staples. The movable interior fastener supporting structure is configured to apply force in the direction of the exterior fastener guiding surface to provide tightened engagement of the brads in the brad package and thereby prevent undesired movement of the brad package in the driving direction in response to the driving structure engaging the lead brad during the driving stroke.

10 Claims, 4 Drawing Sheets

STAPLE AND BRAD DRIVING TOOL

This application claims the benefit of prior filed provisional application No. 60/056,066, filed Sep. 2, 1997.

The present invention relates to a fastener driving device for driving both staples and brads.

Fastener driving devices that drive staples and that also load and drive brads from one side of a magazine present unique technical problems that make it difficult to drive brads successfully. One problem is that there is typically excess clearance for the brad package in the magazine because there are no fasteners on the opposite side of the magazine to restrain movement of the magazine core. Brads typically present unique technical problems because, unlike staples which are loaded in a magazine so that one leg is on each side of the core and the crown extends across the top thereof, brads occupy only one side of a core in the magazine and typically the head of the brad engages the core by hanging thereon by only a small edge. When brads are present on only one side of the core, the core has a tendency to move away from the brad package rather than staying still when the leading brad is being cut off from the package by the action of the driver during a drive stroke. This tendency of the core to move, particularly during the driving operation, can cause too large a space to form between the side of the core and the side wall of a magazine shell which can result in a failure of the core to support the small edge of the brad heads while the first brad is being cut off which can result in double-driving, jams or various other problems.

There are several possible solutions to this problem of how to reliably feed and drive brads that are loaded in a single side of a core in a magazine that is provided with two sides for staples. One solution is to construct the core and the magazine side walls of a rigid material so that the two structures do not change positions relative to one another so that the side walls of the core and the side walls of the magazine remain perfectly aligned. This can be done by welding the two structures together, but such a structure is difficult to manufacture consistently and costly. In addition, when the edges that support the heads of the brads in a package of brads begin to wear at the front near the drive track where a driver cuts off the lead brad and drives it into a workpiece, simultaneous cutting-off of multiple brads could occur because a plurality of brads immediately behind the lead brad in the drive track may not be adequately supported by the core and magazine side walls and therefore the impulse force of the driver on the head of the lead brad would cause them to break from the package. This type of wear could be addressed by heat treating the core and the side walls of the magazine, but consistency of fairly tight tolerances on the welded assembly would be adversely effected. The fastener driver assemblies would have to be adjusted after heat treating occurred to remove the structural distortion which would raise costs.

In accordance with the principles of the present invention there is provided a fastener driving device for driving brads or staples into a workpiece which provides a solution to the problems associated with combination brad/stapler drivers known before. The device comprises a main body structure having a manually engageable portion positioned and configured to allow for manually grasping of the fastener driving device by a user. A magazine assembly is constructed and arranged to receive a fastener package containing a plurality of fasteners connected together. The fasteners are (1) staples when the fastener driving device is being used to drive staples and (2) brads when the fastener driving device is being used to drive brads. The main body structure includes a drive track configured to receive a lead fastener from the fastener package disposed within the magazine assembly. The lead fastener is connected to the fastener package and is positioned to be driven outwardly in a driving direction from the drive track and into the workpiece. The magazine assembly is constructed and arranged to move the fastener package in a feeding direction to thereby feed a successive lead fastener into the drive track after the lead fastener has been driven outwardly in the driving direction from the drive track.

A reciprocating driving structure is mounted for reciprocating movement through a fastener driving cycle. The fastener driving cycle includes (1) a drive stroke wherein the reciprocating driving structure engages and separates the lead fastener disposed in the drive track from the fastener package and drives the lead fastener outwardly in the driving direction from the drive track and into the workpiece and (2) a return stroke wherein the reciprocating driving structure returns from the drive stroke to allow a magazine assembly to feed a successive lead fastener into the drive track from the fastener package. A manually operable actuating assembly is constructed and arranged to actuate the reciprocating driving structure and initiate the fastener driving cycle in response to manual operation.

The magazine assembly is constructed and arranged such that the lead fastener remains connected to the fastener package until the reciprocating driving structure engages the lead fastener and separates it from the fastener package such that force is transmitted in the driving direction to the fastener package during the drive stroke of the fastener driving cycle. The magazine assembly includes a movable interior fastener supporting structure and an exterior fastener guiding surface. The movable interior fastener supporting structure and the exterior fastener guiding surface are spaced apart to define a guide channel therebetween for receiving a portion of a fastener package and to guide the fastener package as it moves in the feeding direction. The movable interior fastener supporting structure is positioned within the interior of a staple package disposed in the magazine assembly so as to support the crowns of the staples in the staple package with the legs on one side of the staple package being disposed in the guide channel, the legs on the other side of the staple being disposed on an opposing side of the movable interior fastener supporting structure, and the exterior fastener guiding surface being disposed exteriorly of the staple package disposed in the magazine assembly when the device is being used to drive staples. The movable interior fastener supporting structure provides a brad head supporting surface constructed and arranged to support a brad package disposed in the guide channel by engaging underside surfaces on one side of the heads of the brads of the brad package when the fastener driving device is being used to drive brads such that underside surfaces on the other side of the heads of the brads are spaced above an upper edge of the exterior fastener guiding surface.

The brad head supporting surface is positioned and configured such that, when the reciprocating driving structure engages the lead brad of the brad package and applies force in the driving direction to the brad package during the drive stroke, the underside surfaces of the brad heads transmit the force in the driving direction to the brad supporting surface of the movable interior fastener supporting structure so that the movable interior fastener supporting structure moves towards the exterior fastener guiding surface and applies force directed towards the exterior fastener guiding surface to the shafts of the brads in the brad package to thereby tightly engage the shafts of the brads in the brad package and prevent undesired movement of the brad package in the aforesaid driving direction when the fastener driving device is being used to drive brads. The movable interior fastener supporting structure is constructed and arranged such that the force being transmitted to the brad supporting surface during the drive stroke is removed after the lead brad has been separated from the brad package so that the movable interior fastener supporting structure moves away from the exterior fastener guiding surface to thereby remove the force being applied to the shafts of the brads and allow the brad package to move along the guide channel in the feeding direction such that a successive lead brad can be moved into the drive track.

Other objects, features, and advantages of the present invention will be realized from the following detailed description, the accompanying drawings, and the appended claims.

DETAILED DESCRIPTION OF THE INVENTION

Figure 1:
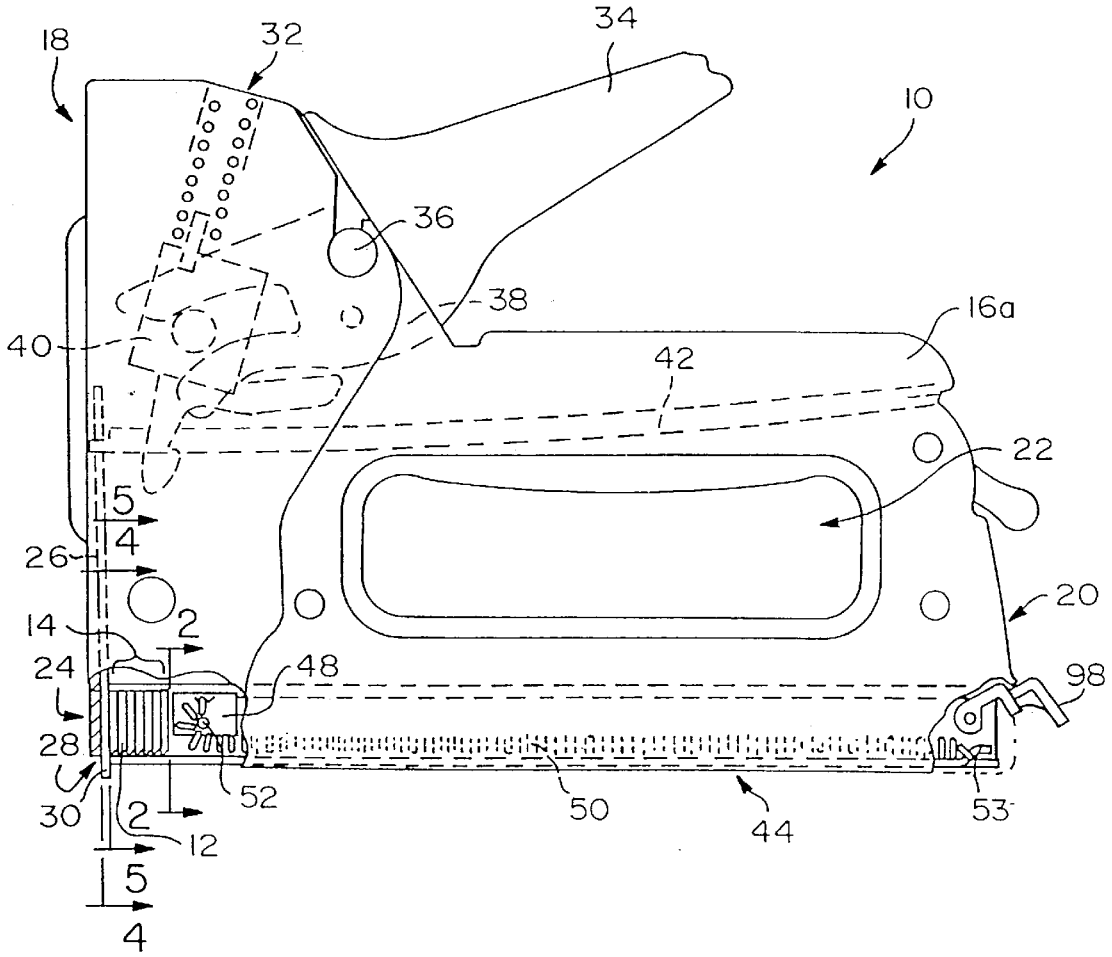
FIG. 1 is a side elevation of a fastener driving device with a bottom loading type magazine showing a plurality of portions of a housing broken away and showing a plurality of structures within the housing in phantom.

Referring now to the drawings, there is shown in FIGS. 1 through 6 the preferred embodiment of a fastener driving device, generally indicated at 10, that is adapted to drive fasteners 12 which are connected together in an elongated assembly or package, indicated generally by the reference numeral 14. The fastener driving device 10 includes a main body structure comprising a matching pair of stamped sides 16*a* and 16*b* shaped to define a head portion 18 and a base portion 20 with an integral finger opening area 22 providing a manually engageable portion. The package of fasteners 14 are mounted in a magazine assembly, generally indicated at 24, which urges a series of leading fasteners 14 in a feeding direction into a drive track 26 where each leading fastener 14 is successively driven outwardly through an exit opening 28 into a workpiece by the normal operation of a reciprocating driving structure 30 which is reciprocally mounted in the drive track 26.

A manually operable actuating assembly is shown in phantom in FIG. 1 and is generally indicated by the reference numeral 32. The actuating assembly may be of any conventional type including electrical, electromechanical, internal combustion or pneumatic. An exemplary actuating assembly 32 is disclosed in U.S. Pat. No. 5,335,839 which issued Aug. 9, 1994 to the present inventor and which is hereby incorporated by reference in its entirety. The manually operable actuating assembly 32 is engaged by depressing a handle assembly 34 which is pivotally mounted to the head portion 18 of the fastener driving tool 10 by a transversally mounted pivot pin 36. A spring loaded mechanical driving assembly is attached to the handle assembly 34 by means of an interiorly protruding bifurcated portion 38 with spaced walls forming an arcuate slot 40. An attached set of pawls extend downwardly and rearwardly, forming a plurality of shoulders that engage a power spring 42. The forward nose of the power spring 42 interlocks in an opening in the upper end of the driver 30. The actuating assembly 32 provides a cyclical means for driving fasteners into a work piece. The fastener driving cycle comprises a return stroke and a drive stroke. The magazine assembly 24 urges a leading fastener in a feeding direction into the drive track 26 during each cycle so that one leading fastener per cycle can be broken off of the package of fasteners and driven in a driving direction into the work piece without jamming or interfering with the rapid cycling of the driving device.

Figure 2:
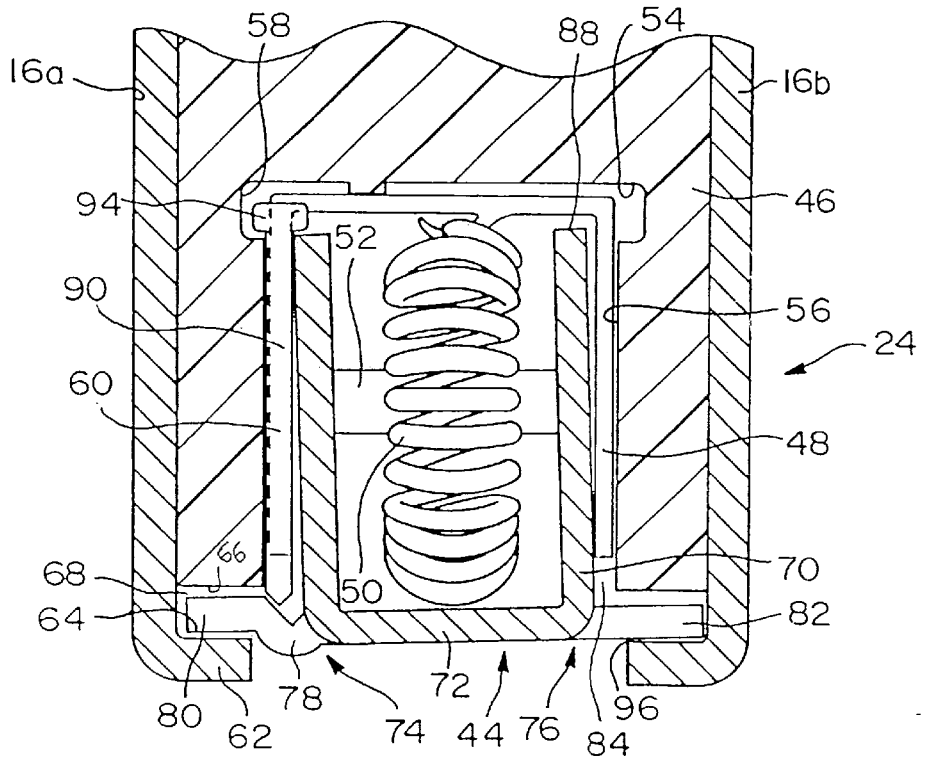
FIG. 2 is a fragmentary sectional view of a magazine assembly taken across the line 2—2 in FIG. 1 showing a tilting or pivoting core structure acting on a brad package shown in phantom in accordance with the present invention.

The magazine assembly 24 is located along a lower longitudinal section of the base portion 20 of the fastener driving tool 10 and is shown in cross section in FIG. 2. The magazine assembly 24 includes a pivoting core structure 44, a magazine shell 46, a pusher member 48, a pusher spring 50 and an end pin member 52. The magazine shell 46 is preferably a molded plastic structure which defines a formed top portion 54, a plurality of side walls 56 and a longitudinally extending cut out portion 58 that functions as a guide channel and a support for one side of a package of brads 60. The magazine shell 46 is enclosed within the lower portions of the housing sides 16 and the housing sides 16 extend downwardly beyond the lower edges of the magazine shell side walls 56 and then extend essentially perpendicularly inward to define a plurality of frame lips 62. An inner face 64 on each of the frame lips 62, the lower portion of the sides 16*a* and 16*b* and the bottom surface 66 of each of the frame side walls 56 cooperate to form a pair of core channels 68 that extend longitudinally along the length of the magazine assembly 24 on each side thereof.

Figure 3:
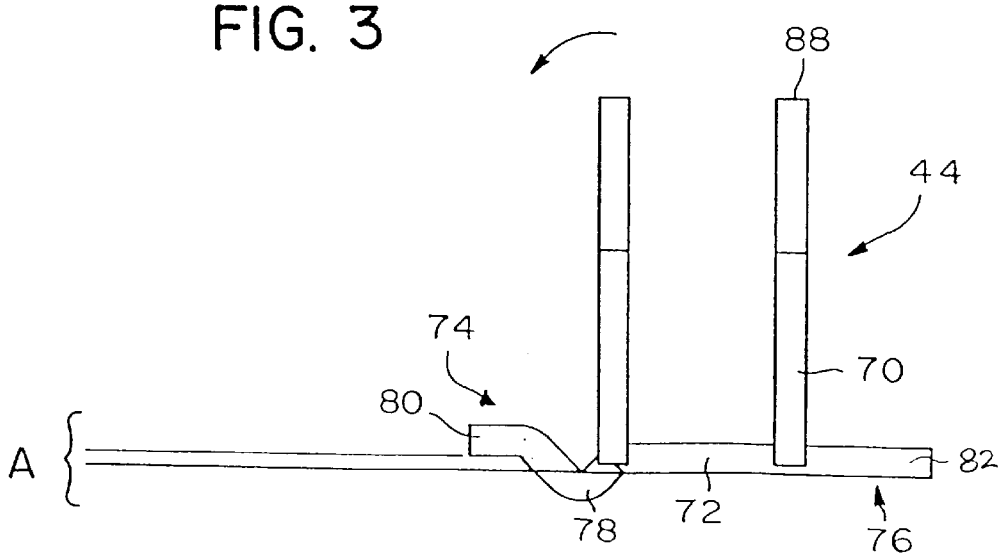
FIG. 3 is an end view of the tilting or pivoting core in isolation showing the amount of free tilt movement the tilting core can effect in a magazine assembly.

The pivoting core structure 44 is a generally U-shaped structure defining a pair of identical, essentially parallel side walls 70 which are rigidly connected to a base portion 72. A plurality of wing portions extend laterally from either side of the base portion 72, including a first core wing portion 74 and a second core wing portion 76. The first core wing portion 74 extends laterally from the core base portion 72 and forms an inner U-shaped portion 78 immediately adjacent to and integral with the base portion 72 and an outer planar extension 80 which extends outwardly from the U-shaped portion. The second core wing portion 76 forms an essentially planar member 82 which extends outwardly from and which is integrally formed with the base portion 72 of the pivoting core structure 44. The outer planar extension 80 of the first core wing portion 74 is in a slightly higher plane than that of the planar member 82 of the second core wing portion 76 so that the vertical height differential between them is about 0.022 inches as shown in FIG. 3 (i.e., they are offset relative to one another). The core wing portions 74 and 76 are slidingly received in the core channel 68. When the pivoting core structure 44 is in position in the core channel 68, the pivoting core structure 44 and the shell 46 cooperate to form a guide channel 84. The core channel 68 is sized to allow for a small amount of free movement for pivoting the pivoting core structure 44 therein. The inner surface 64 of the parallel frame lips 62 provide supporting surfaces for the core wing portions 74 and 76 although when the magazine is loaded, the first core wing portion 74 is not in contact therewith; rather a gap or wing portion-receiving space exists between the core wing portion 74 and the adjacent frame lip to allow pivotal movement of the core structure 44. Since the lateral extensions of the core wing portions 74 and 76 are slightly offset from each other, the core structure 44 will pivot on a frame lip edge, thereby producing a natural tilt toward the occupied portion of guide channel 84 containing the package of brads 60. The pivoting core structure 44 is therefore biased directly against the brad shafts 90 of the brads in the package and effectively holds the package of brads 60 against the magazine shell side wall 56. A top edge 88 of core side wall 70 cooperates with the magazine side wall 56 in order to guide the brad shoulders 92 within guide channel 84.

Stated differently, the movable core structure 44 defines a movable interior fastener supporting structure and the magazine side wall 56 defines a fixed exterior fastener guiding surface. The two brad supporting structures 44, 56 are disposed on opposing sides of the brad package define guide channel 84 therebetween.

The pivoting core structure 44 is shown in isolation in FIG. 3 which indicates the amount of offset between the lateral planar faces 80 and 82, respectively, of core wing portion 74 and core wing portion 76. The end pin 52 is not shown in FIG. 3 to more clearly show the structure of the pivoting core 44. In the preferred embodiment shown in FIG. 3, a differential of 0.022 inch provides the preferred amount of free movement for the pivoting core 44. The reference letter A at the ends of the upper and lower dimension lines in FIG. 3 indicates the surfaces that are being measured are 0.022 inches apart. The core wing portion 76 pivots on the edge of the frame lip 62 thereby pivoting the pivoting core structure 44 toward the brad shafts 90. The side wall 70 of the pivoting core structure 44 then rests against the brad shafts 90. Referring again to FIG. 2, it can be seen that the lateral extensions 78 and 80 of core wing 74 do not come into contact with the inner surface 64 of the adjacent frame lip 62 when a package of brads 60 is loaded therein, but rather forms a small gap therewith. This gap provides space needed for the relative movement between the pivoting core structure 44 and the magazine side wall 56 during driving operations and for automatic adjustment for wear of both the contacting surfaces of the magazine side wall 56 and the core side wall 70 during continued operation of the fastener driving device 10.

Figure 4:
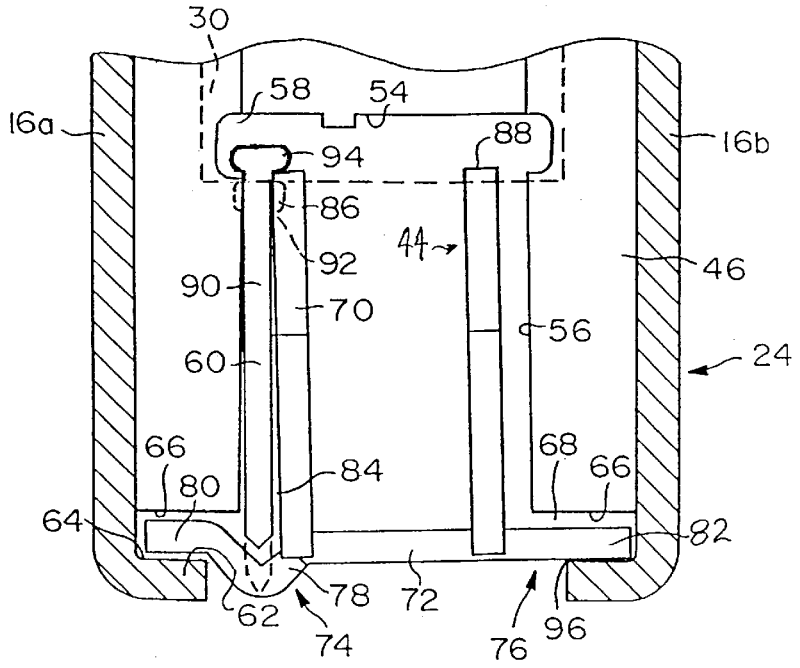
FIG. 4 is a fragmentary sectional view of the magazine area taken through the line 4—4 during a fastener driving operation showing a driver and a brad which is being driven by the driver in phantom.

As shown in FIG. 4, a foremost brad 86, which is shown in phantom in the drive track 26, is no longer connected to the brad package 60 located on the occupied portion of guide channel 84. The end pin 52 and the pusher spring 50 are not shown in FIG. 4 to more clearly show the relative positions of the movable structures and the fixed structures shown therein. The brad package 60 is held in place by the magazine side wall 56 on one side and by the core side wall 70 on the other side such that the underside surfaces of the brads are spaced above the upper edge of the side wall 56. As a driving force is applied in the driving direction to the head 94 of the brad 86 by the driver 30 (also shown in phantom), the brad is driven downward in the driving direction and cut off from the brad package 60. The fastener driver structure 30 first hits the head 94 of the leading brad 86 and transmits a force to the brad package 60 in the driving direction instantaneously, which in turn transmits the force in the driving direction to the core side wall 70. This downward force tends to move the pivoting core 44 about a pivot point 96 toward the brad package 60 and the shell side wall 56 on the opposite side of the brad package 60 which causes the top edge of the core side wall 70 to hold the heads 94 of the brads in the brad package 60 tightly in place in the guide channel 84 while the brad 86 in the drive track is cut off and driven out into the work piece. In other words, the movable core structure 44 (i.e., the movable interior fastener supporting structure) moves relatively toward the magazine side wall 56 (i.e. the fixed exterior fastener guiding surface) in response to the reciprocal driving structure 30 engaging the lead brad during the drive stroke so as to tightly engage the brad package therebetween and thereby prevent movement of the brad package 60 in the driving direction. In normal operation, when the movable interior support structure is facing downwardly or the device is oriented so that the brad 86 is going down, gravity will also tend to pivot the movable interior support structure 44 in a direction toward the side wall 56. Once the cut-off of the brad 86 in the feeding position is accomplished, the instantaneous force which was caused by the motion of the driver structure 30 is no longer applied and the package of brads 60 in the guide channel 84 are then free to move forwardly in the feeding direction until the successive brad 86 is biased against the back surface of the driver structure 30.

The brads 60 are urged in the feeding direction along the pivoting core 44 by the pusher member 48 which is biased forwardly by the pusher spring 50. The pusher spring 50 is attached at a first end to a tab member 53 which is secured to a rear portion of the pivot core base 72 and is attached at a second end to the pusher member 48. The pusher spring 50 is looped around the end pin member 52 which is secured between the two core side walls 70 of the pivoting core 44 so that the pusher spring urges the pusher member 48 forwardly along the core side walls 70.

In accordance with the principles of this invention, it can be appreciated that the relative motion between the magazine side wall 56 and the core side wall 70, takes place without regard to the orientation of the fastener driving device 10. When the fastener driving tool 10 is held in an inverted position, the driving force is applied to the top of the head 94 of the brad 86 in the drive track. The brad 86 is driven toward the driver opening 28 and is cut off from the brad package 60 held within the guide channel 84. This force tends to move the side walls 56 and 70 relatively toward one another which results in a momentary increase in the biasing force exerted by the pivoting core 44 on the brad package 60 in the guide channel 84 and the core top edge 88 holds the brad package 60 snugly in place while cut off and driving takes place. It can thus be understood, therefore, that as the driving force is applied to the brad head 94 in the feeding position, the core side wall 70 moves pivotally about a pivot point toward the magazine side wall 56 without regard to the orientation of the fastener driving device 10, thus assuring that there will be a clean cut off.

Figure 5:
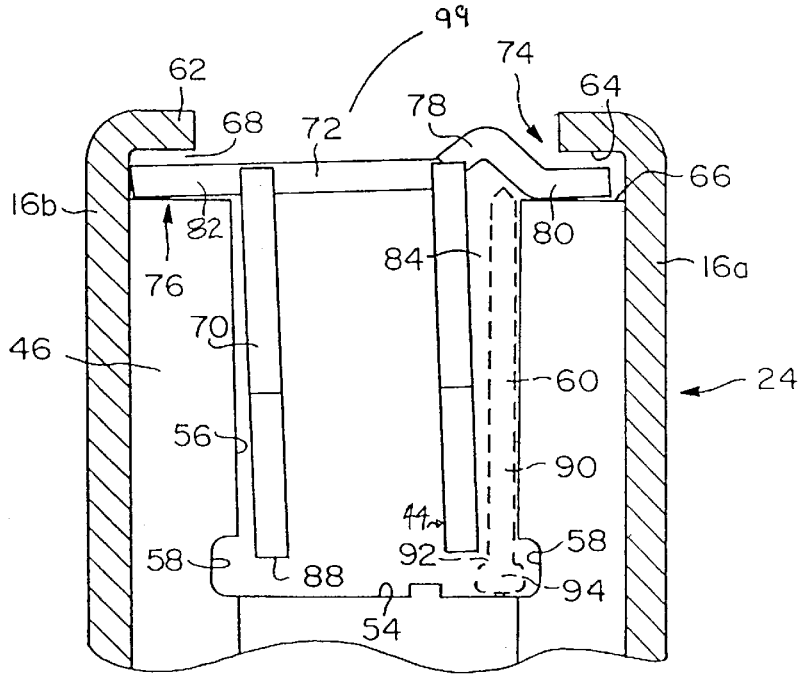
FIG. 5 is a fragmentary sectional view of the magazine area taken along the line 5—5 when the magazine is being loaded and is in an inverted or upward facing orientation and showing a brad package in phantom.

A secondary consideration for a pivoting core design is how this movement between a fixed exterior guiding surface, like a magazine side wall 56, and a movable support structure, like a pivoting core 44, is accommodated in the magazine by virtue of the manner in which the magazine is loaded. There are several different types of magazine assemblies including rear loaders, top loaders, and bottom loaders. The preferred embodiment discussed heretofore is a bottom loader that is of the rectilinear, or sliding, type. In this type of magazine assembly, the movable interior supporting structure, (i.e., the pivoting core 44), moves rectilinearly with respect to the fixed exterior guiding surface (i.e., side wall 56) when the magazine release lever 98 is depressed and the pivoting core 44 slides rearwardly to expose a portion of the magazine shell 46. More specifically, when this type of bottom loader requires reloading of the fasteners, the magazine is opened by sliding the movable supporting structure, the pivoting core 44, rearwardly to a loading position and then inverting the entire fastener driving device 10. When the fastener driving tool 10 is inverted, the pivoting interior core 44 tends to move away from the fixed exterior guiding surface (i.e., wall 56) integrally formed with the magazine shell 46. This configuration is shown in FIG. 5, which shows the relationship between the magazine shell 46 and the pivoting core 44 when the core 44 is unlatched by depressing release lever 98 and moved rearwardly partially out of the housing 16 along core channel 68 to the loading position. FIG. 5 shows that the pivoting core 44 has moved into the loading position so as to receive a new package of fasteners 60 which are shown in phantom. The end pin 52 and the pusher spring 50 are not shown in FIG. 5 to more clearly show the relative positions of the structures shown therein. With the magazine shell 46 of the magazine assembly 24 facing upwardly, a fastener package can be dropped in through the loading opening defined between the frame lips 62. The pivoting core structure 44 is then returned to its operating position while the fastener driving device 10 is held in an inverted position so that the movable supporting structure (the pivoting core 44) slides shut with no interference from the package of brads 60. The movable interior supporting structure (pivoting core 44), moves easily to provide the appropriate clearance for closing the magazine assembly 24. When the fastening driving tool 10 is turned upwardly, the pivoting core 44 will then be biased into engagement with the package of fasteners 60 and the fasteners will then be held by the core side wall 70 against the magazine side wall 56.

With other types of magazine assemblies, such as rear loaders or top loaders, the core or movable support structure and other supporting and guiding surfaces for the package of fasteners are not moved gravitationally during the loading operation. The only movement that typically takes place is the motion of a pusher rearwardly along the support and guide structure to a loading position. It is within the scope of the present invention to provide for one support surface or structure that has relative motion and free movement with respect to another in a rear loading or in a top loading device. A fastener device with one of these other types of magazine assemblies which also incorporates a pivoting core can be loaded with a package of fasteners successfully and easily. More specifically, with the magazine empty and the pusher moved rearwardly to the loading position, the movable structure, or tilting core, may have moved by gravity through its full range of free movement. Because, for purposes of loading, the orientation of the fastener tool is not normally inverted in rear loader and top loaders, the movable support structure does not change orientation during the loading operation and may be tilted toward the channel which will be occupied by the package of fasteners such as brads. With the magazine empty, the tilting core may well be bottomed out in its movement or fully rotated toward the fixed structure immediately prior to loading. Because the pivoting core is free to move in this configuration, however, the package of fasteners can still be easily inserted between the tilting or pivoting core and the fixed structure of the magazine upon which the pivoting core is resting. When the fastener package is loaded into the magazine, the fasteners will engage with the movable interior support structure and cam the tilting core into an operative position. Therefore, this interengagement of the fastener package with the movable support structure will provide the appropriate relative free movement between the movable interior support structure and the fixed exterior guiding surface within the magazine to successfully load the magazine and to pivot the pivoting core into an operating position to facilitate the desired operation when driving a fastener.

The operation of the fastener driving device 10 as described herein is shown in FIG. 4 which shows that the cut-off driving motion of the driver 30 as it contacts the head of the brad in the drive track during the drive stroke itself provides the motive force for the relative movement between the movable support structure and the fixed guiding surface so that the pivoting core 44 tends to pivot in a direction toward the magazine side wall 56. When the fastener driving tool 10 is facing downwardly so that the brad 86 is driven downwardly, gravitational force tends to pivot the pivoting core 44 about a pivot point 96 in a direction toward an inwardly facing side of the brad package 60 and toward the magazine side wall 56 supporting the other side of the brad package 60. During a driving operation, the brad shoulders 92 cooperate to transmit a portion of the shear force supplied by the driver 30 to the leading fastener during the cut off operation to the top edge 88 of the core side wall 70 to utilize the free movement of the pivoting core 44 to pivotally urge the pivoting core side wall 70 against the brad shafts 90 thereby holding the brad package 60 tightly against the magazine side wall 56 during the cut off and driving operation. With the fastener driving device 10 either inverted or in some other orientation, the pivoting core 44 may have moved away from the fixed support structure 56. When driving motion is initiated, the head 94 of the leading brad 86 in the drive track 26 will be driven toward the exit opening 28 in the driving direction and this force will be transmitted to the brad package 60 in the guide channel 84 by the cut off operation and the brad shoulders 92 of the brads in the package 60 will transmit a force to the core side wall 70 causing relative movement between the pivoting core 44 and the magazine side wall 56 such that the pivoting core 44 will pivot against the brad package 60. The pivoting core side wall 70 will firmly hold the brads 60 against the magazine side wall 56 during the cut off.

Figure 6:
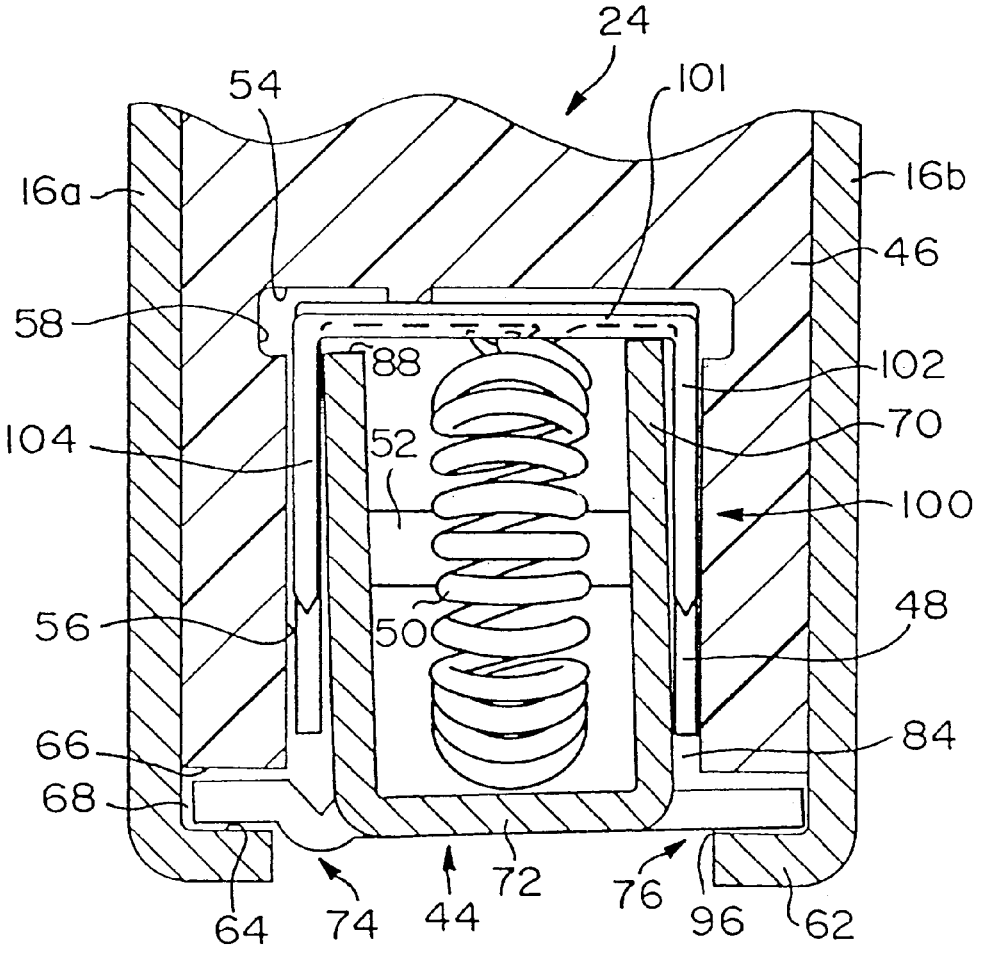
FIG. 6 is a fragmentary sectional view of a the magazine assembly as in FIG. 2 showing the tilting core supporting a package of staples.

As shown in FIG. 6, the pivoting core 44 can be used to successfully feed and drive staples. When driving staples, indicated at 100, it can be seen that the legs of the staples 104, occupy both sides of the guide channel 84. The pivoting core 44, will pivotally engage the staple legs 104 regardless of the orientation of the fastener driving device 10. Therefore, the two sides of the pivoting core 44 need not be vertical to function normally to drive a plurality of staples one at a time in rapid succession. It can be appreciated, however, that when driving motion is initiated, the driving force is applied to the crown 101 of the leading staple 102 in the drive track 26 and the pivoting core 44 acts pivotally to direct a core side wall 70 against the staple legs 104, thereby tightly holding the staple legs 104 against the magazine side wall 56 during the cut off and driving operation. Therefore, the staple 100 in the drive track 26 will be cleanly cut off and driven in like manner as a brad 86 or other fastener regardless of the orientation of the fastener driving tool 10.

It will thus be seen that the principles of the present invention have been fully and effectively accomplished. It is to be understood, however, that the foregoing embodiments are provided to illustrate the functional and structural principles of the present invention. Thus, the present invention includes all modifications or alterations within the spirit and scope of the following claims.

Any patents or patent applications mentioned in the present application are hereby incorporated into the present application in their entirety.

It is to be understood that the use of "means-plus-function" language has been purposely omitted from the appended claims so that it is clear that these claims are not intended to be interpreted under 35 U.S.C. § 112, paragraph 6.

What is claimed is:

1. A fastener driving device for driving brads or staples into a workpiece, said device comprising:

a main body structure having a manually engageable handle portion positioned and configured to allow for manual handling of said fastener driving device by a user;

a magazine assembly constructed and arranged to receive a fastener package containing a plurality of fasteners connected together, the fasteners being (1) staples when said fastener driving device is being used to drive staples and (2) brads when said fastener device is being used to drive brads;

structure defining a drive track configured to receive a lead fastener of the fastener package disposed within said magazine assembly, the lead fastener being connected to the fastener package and being positioned to be driven outwardly in a driving direction from said drive track and into the workpiece;

said magazine assembly being constructed and arranged to move the fastener package in a feeding direction to thereby feed a successive lead fastener into said drive track after the lead fastener has been driven outwardly in the driving direction from said drive track;

a reciprocating driving structure mounted for reciprocating movement through a fastener driving cycle, said fastener driving cycle including (1) a drive stroke wherein said reciprocating driving structure engages and separates the lead fastener disposed in said drive track from the fastener package and drives the lead fastener outwardly in the driving direction from said drive track and into the workpiece and (2) a return stroke wherein said reciprocating driving structure returns from said drive stroke to allow said magazine assembly to feed a successive lead fastener into said drive track from the fastener package;

a manually operable actuating assembly constructed and arranged to initiate said fastener driving cycle in response to manual operation;

said magazine assembly being constructed and arranged such that the lead fastener remains connected to the fastener package until said reciprocating driving structure engages the lead fastener and separates it from said fastener package such that force in the driving direction is transmitted to the fastener package during said drive stroke of said fastener driving cycle;

said magazine assembly including a movable interior fastener supporting structure and an exterior fastener guiding surface, said movable interior fastener supporting structure and said exterior fastener guiding surface being spaced apart to define a guide channel therebetween for receiving a portion of a fastener package and to guide the fastener package as it moves in the feeding direction;

said movable interior fastener supporting structure being positioned within the interior of a staple package disposed in said magazine assembly so as to support the crowns of the staples in the staple package with the legs on one side of the staple package being disposed in said guide channel, the legs on the other side of the staple package being disposed on an opposing side of said interior fastener supporting structure, and said exterior fastener guiding surface being disposed exteriorly of the staple package disposed in said magazine assembly when said device is being used to drive staples;

said movable interior fastener supporting structure providing a brad head supporting surface constructed and arranged to support a brad package disposed in said guide channel by engaging underside surfaces on one side of the heads of the brads of the brad package when the fastener driving device is being used to drive brads such that underside surfaces on the other side of the heads of the brads are spaced above an upper edge of said exterior fastener guiding surface;

said brad head supporting surface being positioned and configured such that, when said reciprocating driving structure engages the lead brad of the brad package and applies force in the driving direction to the brad package during said drive stroke, the underside surfaces on the one side of the brad heads transmit the force in the driving direction to said brad supporting surface of said movable interior fastener supporting structure so that said movable interior fastener supporting structure moves towards said exterior fastener guiding surface and applies force directed towards said exterior fastener guiding surface to the shafts of the brads in the brad package to thereby tightly engage the shafts of the brads in the brad package and prevent undesired movement of the brad package in the aforesaid driving direction when said fastener driving device is being used to drive brads;

said movable interior fastener supporting structure being constructed and arranged such that said force being transmitted to said brad supporting surface during said drive stroke is removed after the lead brad has been separated from the brad package so that said movable interior fastener supporting structure moves away from said exterior fastener guiding surface to thereby remove said force being applied to the shafts of the brads and allow the brad package to move along said guide channel in the feeding direction such that a successive lead brad can be moved into said drive track.

2. A fastener driving device according to claim 1, wherein said movable interior fastener supporting structure is a movable core structure.

3. A fastener driving device according to claim 2, wherein said magazine assembly comprises a magazine shell providing a pair of longitudinally extending magazine side walls, said movable core structure being disposed between said magazine side walls.

4. A fastener driving device according to claim 3, wherein said movable core structure comprises a pair of generally parallel side walls, a base portion connecting said generally parallel side walls, and a pair of wing portions extending outwardly from opposing sides of said movable core structure, said wing portions being received within wing portion-receiving spaces provided in said magazine assembly, the wing portion disposed proximate to said exterior fastener guiding surface being offset relative to the wing portion disposed opposite said exterior fastener guiding surface such that said movable core structure is pivotable about a pivot point defined on said wing portion disposed opposite said fixed exterior fastener guiding surface and biased towards said exterior fastener guiding surface.

5. A fastener driving device according to claim 4, wherein said wing portion proximate said exterior brad guiding surface has a recessed portion providing clearance for the penetrating end of the brads.

6. A fastener driving device according to claim 5, wherein said magazine shell is enclosed within said main body structure, said main body structure providing inwardly extending lip portions which cooperate with said magazine shell to define said wing portion-receiving spaces.

7. A fastener driving device according to claim 6, wherein said magazine assembly further comprises:

a pusher member; and a pusher spring, said pusher member being engageable with the fastener package and said pusher spring being configured to urge the fastener package in the feeding direction after the lead fastener has been driven from said drive track.

8. A fastener driving device according to claim 7, wherein said manually operable actuating assembly includes a handle assembly pivotally mounted to said main body structure.

9. A fastener driving device according to claim 7, wherein said inwardly extending lip portions of said main body structure define a loading opening therebetween, said movable core structure being constructed and arranged to pivot away from said exterior fastener guiding surface when said fastener driving device is inverted such that movable core structure is moved out of engagement with the brad package disposed in said guide channel when said device is being used to drive brads, said loading opening facing upwardly when said device is inverted;

said movable core structure being movable rectilinearly relative to said magazine shell to a loading position during a loading operation wherein a fastener package is loaded into said magazine assembly by inserting the fastener package through said loading opening and then moving said movable core structure rectilinearly relative to said magazine shell to an operating position.

10. A fastener driving device according to claim 9, wherein, when said device is inverted and being used to drive brads and said movable core structure is in said operating position, the brad package moves in said driving direction in response to said driving structure engaging the lead brad of the brad package such that the underside surfaces of the heads on the one side of the brads in the brad package engage the brad supporting surface of said movable core structure so as to cause said movable core structure to move towards said exterior fastener guiding surface and apply force directed towards said exterior fastener guiding surface to the shafts of the brads to thereby tightly engage the shafts of the brads in the brad package and prevent undesired further movement of the brad package in the aforesaid driving direction.

* * * * *